US009644461B2

(12) United States Patent
Castillo et al.

(10) Patent No.: US 9,644,461 B2
(45) Date of Patent: May 9, 2017

(54) FLOW CONTROL DEVICE AND METHOD

(71) Applicants: Jose Rafael Gonzalez Castillo, Katy, TX (US); Nadine Macklin, Katy, TX (US)

(72) Inventors: Jose Rafael Gonzalez Castillo, Katy, TX (US); Nadine Macklin, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 296 days.

(21) Appl. No.: 14/596,488

(22) Filed: Jan. 14, 2015

(65) Prior Publication Data

US 2016/0201431 A1 Jul. 14, 2016

(51) Int. Cl.

| | |
|---|---|
| ***E21B 43/12*** | (2006.01) |
| ***E21B 34/14*** | (2006.01) |
| *E21B 34/00* | (2006.01) |

(52) U.S. Cl.

CPC ..... *E21B 43/12* (2013.01); *E21B 34/14* (2013.01); *E21B 2034/007* (2013.01)

(58) Field of Classification Search

CPC ..... F16K 3/26; F16K 3/262; F16K 3/265
See application file for complete search history.

(56) References Cited

U.S. PATENT DOCUMENTS 5,211,241 A * 5/1993 Mashaw, Jr. ..... E21B 43/12 166/320
7,290,606 B2 11/2007 Coronado et al.
7,708,068 B2 5/2010 Hailey, Jr.
8,469,107 B2 6/2013 O'Malley et al.
9,441,468 B1 * 9/2016 Pryor ..... E21B 43/124
2002/0020534 A1 2/2002 Wilson et al.
2006/0113089 A1 6/2006 Henriksen et al.
2009/0277650 A1 * 11/2009 Casciaro ..... E21B 21/103 166/386
2011/0073308 A1 * 3/2011 Assal ..... E21B 43/08 166/278
2011/0139453 A1 6/2011 Schultz et al.
2011/0186300 A1 * 8/2011 Dykstra ..... E21B 34/08 166/316

(Continued)

OTHER PUBLICATIONS

International Search Report and the Written Opinion of the International Searching Authority; PCT/US2015/064811; Date of Mailing Feb. 17, 2016; 10 pages.

*Primary Examiner* — Blake Michener
*Assistant Examiner* — Kenneth Beyers
(74) *Attorney, Agent, or Firm* — Cantor Colburn LLP

(57) ABSTRACT

A flow control device having a longitudinal axis includes an outer housing having at least one fluid inlet, a multi-channel flow member positioned radially within the outer housing, a plurality of flow channels formed between the outer housing and the flow member, at least two of the plurality of flow channels having a different flow resistance rating from each other, and a radial window formed in an outlet region of each of the plurality of flow channels. The flow control device further includes a sliding sleeve positioned radially within the multi-channel flow member, the sliding sleeve including a first section of radial slots. The first section of radial slots is configured to align with a selected radial window via longitudinal movement of the sliding sleeve with respect to the multi-channel flow member.

21 Claims, 9 Drawing Sheets

(56) References Cited

U.S. PATENT DOCUMENTS

| | | | | |
|---|---|---|---|---|
| 2012/0298370 | A1 | 11/2012 | Xu et al. | |
| 2014/0158361 | A1* | 6/2014 | Cheng | E21B 23/006 166/308.1 |
| 2014/0251627 | A1 | 9/2014 | Holderman et al. | |

* cited by examiner

FLOW CONTROL DEVICE AND METHOD

BACKGROUND

In the drilling and completion industry, the formation of boreholes for the purpose of production or injection of fluid is common.

Hydrocarbons such as oil and gas are recovered from a subterranean formation using a well or wellbore drilled into the formation. In some cases the wellbore is completed by placing a casing along the wellbore length and perforating the casing adjacent each production zone (hydrocarbon bearing zone) to extract fluids (such as oil and gas) from the associated a production zone. In other cases, the wellbore may be open hole, i.e. no casing. One or more inflow control devices are placed in the wellbore to control the flow of fluids into the wellbore. These flow control devices and production zones are generally separated by packers installed between them. Fluid from each production zone entering the wellbore is drawn into a tubular that runs to the surface. It is desirable to have a substantially even flow of fluid along the production zone. Uneven drainage may result in undesirable conditions such as invasion of a gas cone or water cone. In the instance of an oil-producing well, for example, a gas cone may cause an in-flow of gas into the wellbore that could significantly reduce oil production. In like fashion, a water cone may cause an in-flow of water into the oil production flow that reduces the amount and quality of the produced oil.

A deviated or horizontal wellbore is often drilled into a production zone to extract fluid therefrom. Several inflow control devices are placed spaced apart along such a wellbore to drain formation fluid or to inject a fluid into the formation. Formation fluid often contains a layer of oil, a layer of water below the oil and a layer of gas above the oil. For production wells, the horizontal wellbore is typically placed above the water layer. The boundary layers of oil, water and gas may not be even along the entire length of the horizontal well. Also, certain properties of the formation, such as porosity and permeability, may not be the same along the well length. Therefore, fluid between the formation and the wellbore may not flow evenly through the inflow control devices. For production wellbores, it is desirable to have a relatively even flow of the production fluid into the wellbore and also to inhibit the flow of water and gas through each inflow control device. Passive inflow control devices are commonly used to control flow into the wellbore. Such inflow control devices are set to allow a certain flow rate therethrough and then installed in the wellbore and are not designed or configured for downhole adjustments. Sometimes it is desirable to alter the flow rate from a particular zone. This may be because a particular zone has started producing an undesirable fluid, such as water or gas, or the inflow control device has clogged or deteriorated and the current setting is not adequate, etc. To change the flow rate through such passive inflow control devices, the production string is pulled out, which is very expensive and time consuming.

The art would be receptive to alternative devices and for flow control devices, and improved methods for operating such devices.

BRIEF DESCRIPTION

A flow control device having a longitudinal axis includes an outer housing having at least one fluid inlet, a multi-channel flow member positioned radially within the outer housing, a plurality of flow channels formed between the outer housing and the flow member, at least two of the plurality of flow channels having a different flow resistance rating from each other, and a radial window formed in an outlet region of each of the plurality of flow channels. The flow control device further includes a sliding sleeve positioned radially within the multi-channel flow member, the sliding sleeve including a first section of radial slots. The first section of radial slots is configured to align with a selected radial window via longitudinal movement of the sliding sleeve with respect to the multi-channel flow member.

A method of controlling flow between an annulus of a borehole and an interior of a tubing uses the flow control device and includes selecting a desired flow resistance rating amongst the plurality of flow channels, and moving the sliding sleeve longitudinally within the multi-channel flow member until the first section of slots aligns with the radial window of a flow channel having the desired flow resistance rating.

BRIEF DESCRIPTION OF THE DRAWINGS

The following descriptions should not be considered limiting in any way.

With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
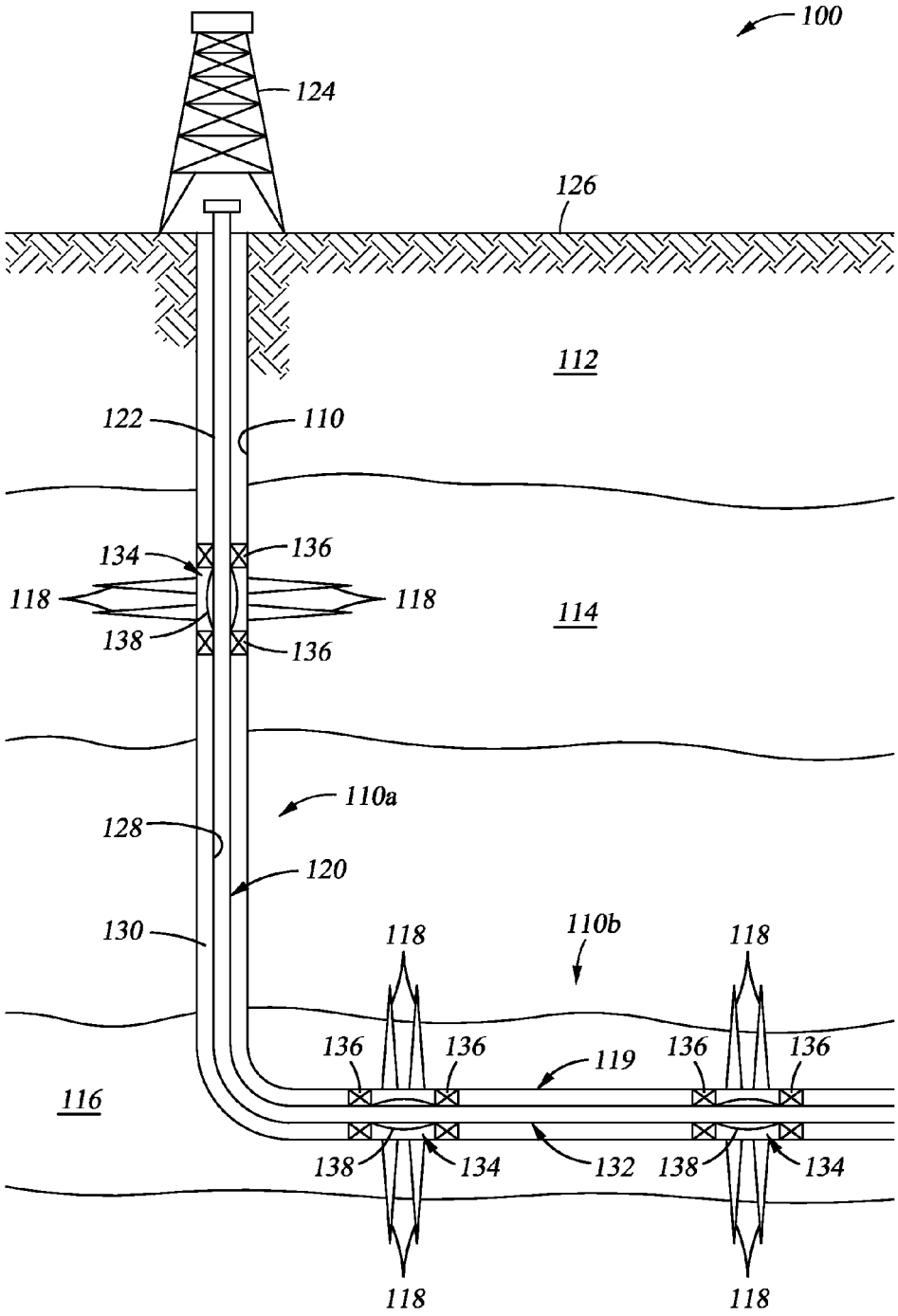
FIG. 1 is a schematic elevation view of an embodiment of a multi-zone wellbore that has a production string installed therein, which production string includes one or more downhole-adjustable inflow control devices made according to an embodiment of the disclosure.

Referring initially to FIG. 1, there is shown an embodiment of a production wellbore system 100 that includes a borehole 110 drilled through an earth formation 112 and into a pair of production zones or reservoirs 114, 116. The borehole 110 is shown lined with a casing having a number of perforations 118 that penetrate and extend into the formations production zones 114, 116 so that production fluids may flow from the production zones 114, 116 into the borehole 110. Alternatively, the borehole 110 may be an open borehole without a casing. The embodiment of the borehole 110 is shown to include a vertical section 110*a* and a substantially horizontal section 110*b*. The borehole 110 include a string (or assembly) 120 that includes a tubing (also referred to as the base pipe) 122 that extends downwardly from a wellhead 124 at the surface 126 of the borehole 110. The string 120 may be a production string or a drill string. The string 120 defines an internal axial bore 128 along its length. An annulus 130 is defined between the string 120 and the borehole casing or borehole wall. The string 120 is shown to include a generally horizontal portion 132 that extends along the deviated leg or section 110*b* of the borehole 110. Devices 134 are positioned at selected locations along the production string 120. Optionally, each device 134 may be isolated within the borehole 110 by a pair of packer devices 136. Although only two devices 134 are shown along the horizontal portion 132, a large number of such devices 134 may be arranged along the horizontal portion 132.

Each device 134 includes a downhole-adjustable flow control device 138, as will be further described below, to govern one or more aspects of flow of one or more fluids from the zones into the string 120. The downhole-adjustable flow control device 138 may have a number of alternative structural features that provide selective operation and controlled fluid flow therethrough. As used herein, the term "fluid" or "fluids" includes liquids, gases, hydrocarbons, multi-phase fluids, mixtures of two of more fluids, water and fluids injected from the surface, such as water. Additionally, references to water should be construed to also include water-based fluids; e.g., brine or salt water.

Subsurface formations typically contain water or brine along with oil and gas. Water may be present below an oil-bearing zone and gas may be present above such a zone. A horizontal borehole, such as section 110*b*, is typically drilled through a production zone, such as production zone 116, and may extend more than 5,000 feet in length. Once the borehole has been in production for a period of time, water may flow into some of the devices 134. The amount and timing of water inflow can vary along the length of the production zone. It is desirable to have flow control devices 138 that can be easily adjusted downhole as desired to control flow of unwanted fluids and/or to alter the flow there through for equalizing flow.

Figure 2:
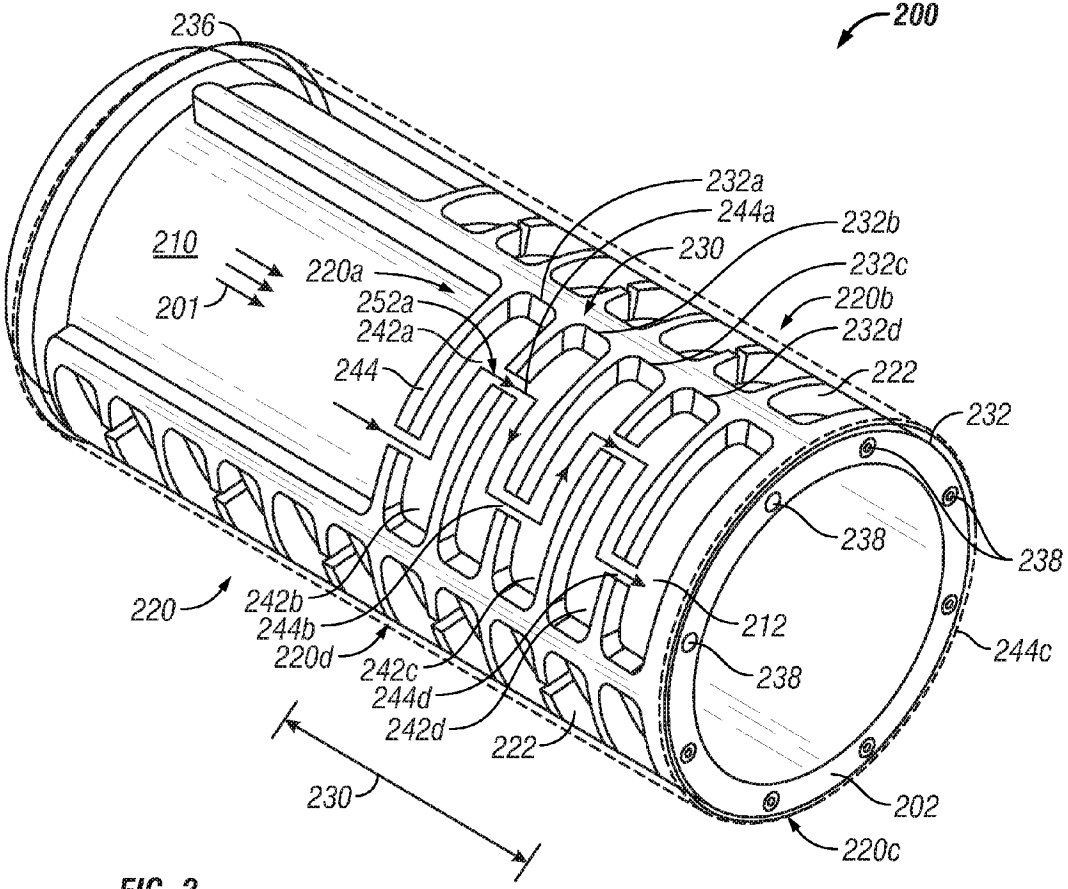
FIG. 2 (PRIOR ART)
FIG. 2 shows an isometric view of a portion of passive inflow control member made according to the prior art.

FIG. 2 shows an isometric view of an embodiment of a portion of an exemplary multi-channel inflow control device 200 according to the prior art that has been previously used in a production string and borehole. The inflow control device 200 has been included as a downhole-adjustable flow control device for controlling the flow of fluids from a reservoir into a production string. The production device that includes the inflow control device 200 may include a filtration device for reducing the amount and size of particulates entrained in the fluids and the inflow control device 200 that controls the overall drainage rate of the formation fluid into the borehole. As depicted, the inflow control device 200 is shown to include a number of structural flow sections 220*a*, 220*b*, 220*c* and 220*d* formed around a tubular member 202, each such section defining a flow channel or flow path. Each section is configured to create a predetermined pressure drop to control a flow rate of the production fluid from the formation into the wellbore tubing. One or more of these flow paths or sections is occluded or independent (not in hydraulic communication with another section) in order to provide a selected or specified pressure drop across such sections.

As depicted, the total pressure drop across the inflow control device 200 is the sum of the pressure drops created by each active section. Structural flow sections 220*a*-220*d* are also referred to as flow channels or flow-through regions. To simplify description of the inflow control device 200, the flow control through each channel is described in reference to channel 220*a* Channel 220*a* is shown to include an outflow region or area 212 (also referred to as "first flow region") and an inflow region 210 (also referred to as "second flow region"). Formation fluid enters the channel 220*a* into the inflow region 210 and exits the channel via outflow region 212. Channel 220*a* creates a pressure drop by channeling the flowing fluid through a flow-through region 230, which includes a plurality of flow stages or conduits, such as stages 232*a*, 232*b*, 232*c* and 232*d*. Each channel in the inflow control device 200 is shown to include a different number of stages, and each channel or stage is configured to provide an independent flow path between the inflow region and the outflow region. The channels 220*a*-220*d* are substantially hydraulically isolated from one another. That is, the flow across the channels and through the device 200 may be considered in parallel rather than in series. Thus, a production device that includes the inflow control device 200 enables flow across a selected channel while partially or totally blocking flow in the other channels. The inflow control device 200 blocks one or more channels without substantially affecting the flow across another channel. It should be understood that the term "parallel" is used in the functional sense rather than to suggest a particular structure or physical configuration.

Still referring to FIG. 2, there are shown further details of the inflow control device 200, which creates a pressure drop by conveying the in-flowing fluid through one or more of the plurality of channels 220*a*-220*d*. Each of the channels 220*a*-220*d* is formed along a wall of a base tubular or mandrel 202 and include structural features configured to control flow in a predetermined manner. The channels 220*a*-220*d* are aligned in a parallel fashion and longitudinally along the long axis of the mandrel 202. Generally, channels 220*a*-220*d* are separated from one another, for example in the region between their respective inflow and outflow regions.

The channel 220*a* is arranged as a maze or labyrinth structure that forms a tortuous or circuitous flow path for the fluid flowing therethrough. Each stage 232*a*-232*d* of channel 220*a* respectively includes a chamber 242*a*-242*d*. Openings 244*a*-244*d* hydraulically connect chambers 242*a*-242*d* in a serial fashion. Formation fluid enters into the inflow region 210 and discharges into the first chamber 242*a* via port or opening 244*a*. The fluid then travels along a tortuous path 252*a* and discharges into the second chamber 242*b* via port 244*b* and so on. Each of the ports 244*a*-244*d* exhibit a certain pressure drop across the port that is a function of the configuration of the chambers on each side of the port, the offset between the ports associated therewith and the size of each port. The stage configuration and structure within determines the tortuosity and friction of the fluid flow in each particular chamber, as described herein. Different stages in a particular channel are configured to provide different pressure drops. Thus, the inflow control device 200 provides a plurality of flow paths from the formation into the tubular.

The inflow control device 200 includes a plurality of axially arranged ports 238, arranged parallel to the longitudinal axis of the inflow control device 200, provided in the mandrel 202 that allows fluid from the outflow regions 212 to pass in the longitudinal direction. Fluid flow through a particular section and into the tubular is controlled by closing ports 238 for the non-selected flow section, leaving the ports 238 open for the selected section. A tubular member (not shown) adjoins the ports and thereby exposes one or more selected ports, depending on parameters and conditions of the surrounding formation. U.S. Pat. No. 8,469,107, incorporated herein by reference in its entirety, describes a system for accessing selected ports 238 involving a rotationally indexed member, spring biased guide sleeve, and collet. The selecting of the ports 238 may also be performed at the rig site or workshop prior to deployment by plugging the non-selected ports 238.

As discussed below, a downhole-adjustable flow control device 138 is configured to enable adjustment of the flow path through a multi-channel flow member, thereby customizing the device based on formation and fluid flow characteristics. The channel or flow path is selected based on formation fluid content or other measured parameters. Turning now to FIGS. 3-8, one embodiment of the device 134 that includes the downhole-adjustable flow control device 138 is shown. The device 134 includes a longitudinal axis 12. The flow control device 138, sometimes referred to as an inflow control device or "ICD," includes an outer housing 14, which may include a substantially imperforate section 16 and at least one ported or screened section 18. Radially interior to the outer housing 14 is a multi-channel flow member 20. The outer housing 14 may be fixedly secured to the exterior of the multi-channel flow member 20. The multi-channel flow member 20 includes a plurality of tortuous flow channels 22 disposed on the exterior surface 24 of the multi-channel flow member 20. Each flow channel 22 may include a number of chambers 26 interconnected by openings 28 to define a particular flow resistance rating ("FRR"). For example, a first flow channel 30 in a first quadrant of the multi-channel flow member 20 has a 0.8 FRR because fluid flowing through the first flow channel 30 experiences 0.8 Barr pressure drops; a second flow channel 32 in a second quadrant of the multi-channel flow member 20 has a 1.6 FRR; a third flow channel 34 in a third quadrant of the multi-channel flow member 20 has a 3.2 FRR; and a fourth flow channel 36 in a fourth quadrant of the multi-channel flow member 20 has a 6.4 FRR. In the illustrated embodiment of the multi-channel flow member 20, the greater FRR is simply created by having a larger number of stages/chambers 26, however the FRR could alternatively be adjusted by changing the sizes of the stages/chambers 26 and the sizes of the interconnecting openings 28. Further, while particular FRRs have been disclosed for the first through fourth flow channels 30, 32, 34, 36, it should be understood that the flow channels 22 of the multi-channel flow member 20 may have any FRR necessary for an expected borehole operation. Also, while the multi-channel flow member 20 is shown as having four quadrants and four flow channels 30, 32, 34, 36, the multi-channel flow member 20 may include any number of flow channels 22. In an alternative embodiment, instead of providing walls 38 on the exterior surface 24 of the multi-channel flow member 20 to create the flow channels 22 between the multi-channel flow member 20 and the outer housing 14, the walls 38 defining the flow channels 22 could extend from an interior surface 40 of the outer housing 14. The multi-channel flow member 20 includes at least one open or by-pass port 42 that may be arranged substantially adjacent to the screened or ported section 18 of the outer housing 14. The multi-channel flow member 20 further includes a radial window 44 positioned within an end or outlet region 46 (FIG. 9) of each flow channel 22. The sizes of the radial windows 44 may be the same or different for each flow channel 22. Also, the radial window 44 for each flow channel 22 is positioned at a longitudinal location with respect to the outer housing 14 that is different than the longitudinal locations of the radial windows 44 for the other flow channels 22. That is, the radial windows 44 are spaced longitudinally with respect to the longitudinal axis 12 of the production device 134.

The multi-channel flow member 20 is fixedly secured, such as via a threaded section or otherwise, to tubular sections of the string 120, such as tubing 122. Radially interior to the multi-channel flow member 20 and tubing 122 is a sliding sleeve 50. The sleeve 50 includes at least a first section of radial slots 52 and a second section of radial slots 54. Each section 52, 54 of radial slots is framed by a pair of seals 56, such as, by not limited to, chevron seal stacks. Movement of the sleeve 50 in opposing longitudinal directions 58, 60 (such as downhole or uphole directions) aligns the first and second sections of radial slots 52, 54 with either an imperforate portion 62 of the multi-channel flow member 20, one of the radial windows 44, or the by-pass port 42. It should be understood that while the view of the downhole-adjustable flow control device 138 is rotated 90 degrees to depict the different quadrants of the device 138 in FIGS. 3-8, no physical rotation of the device 138 or any of its components is required to select one of the flow channels 44. On the contrary, only a longitudinal movement of the sliding sleeve 50 is required. Longitudinal movement of the sliding sleeve 50 may be mechanically accomplished using a wireline tool or slickline tool, coiled tubing or tractor, or may be accomplished using hydraulic activation or electrical activation.

Figure 3:
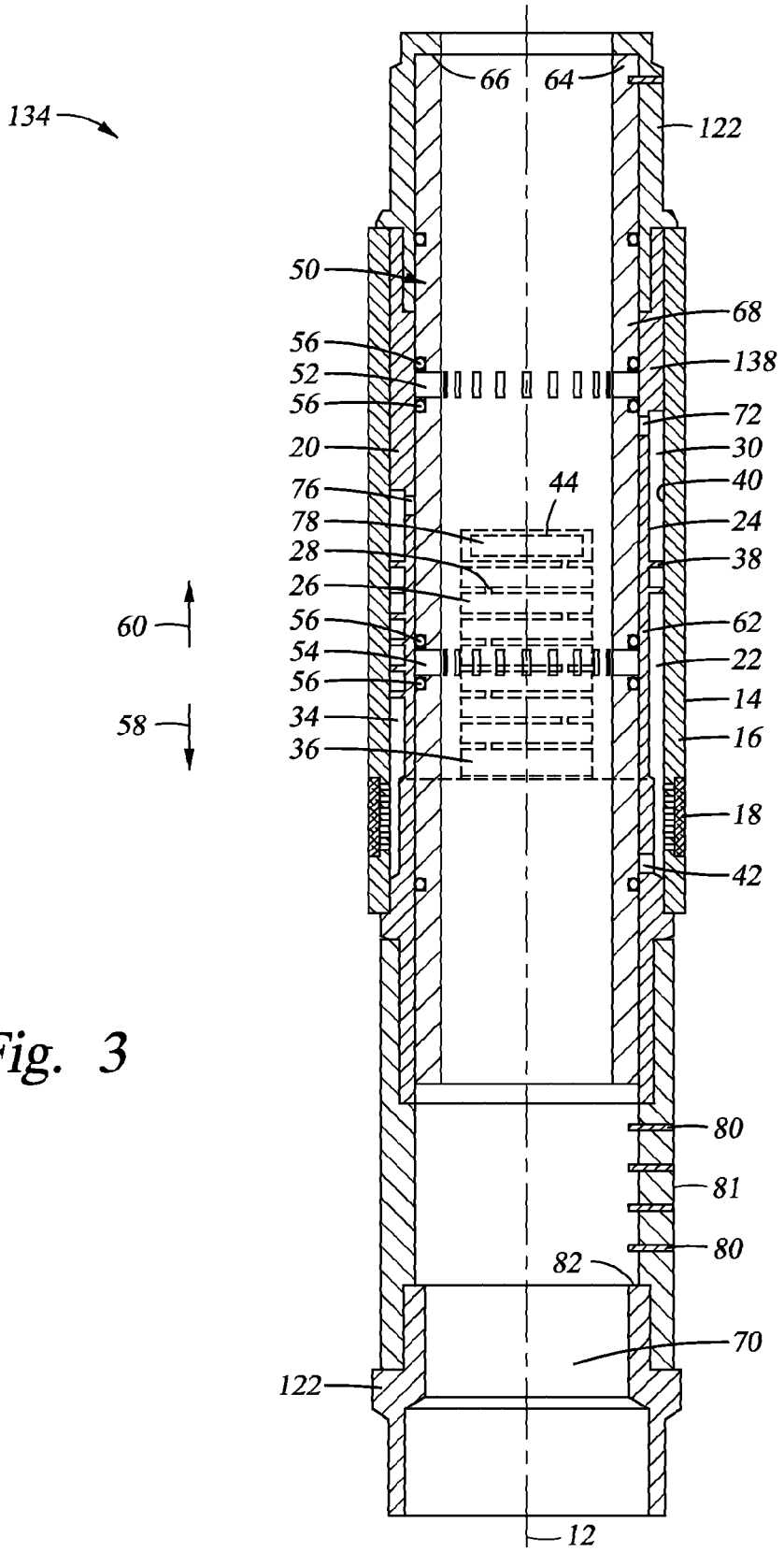
FIG. 3 shows a side partial section view of an embodiment of an adjustable flow control device in a first position corresponding to a closed condition.

FIG. 3 demonstrates a closed condition of the downhole-adjustable flow control device 138. A first end 64 of the sliding sleeve 50 may abut with a first shoulder 66 in the tubing 122 to prevent the sliding sleeve 50 from misaligning with the respect to the multi-channel flow member 20, and to provide an indication of positioning of the sliding sleeve 50 within the multi-channel flow member 20. With the sliding sleeve 50 in the first position, such as, but not limited to, an end position, the radial windows 44 of the flow channels 22 of the multi-channel flow member 20, as well as the bypass port 42, are blocked from fluid communication with an interior of the sliding sleeve 50 and production device 134 by imperforate (solid-walled) sections 68 of the sliding sleeve 50. Likewise, the first and second sections of radial slots 52, 54 of the sliding sleeve 50 are blocked from fluid communication with the flow channels 22 between the multi-channel flow member 20 and outer housing 14 by imperforate (solid-walled) sections 62 of the multi-channel flow member 20. Thus, when the sliding sleeve 50 is in the first position shown in FIG. 3, the downhole-adjustable flow control device 138 is in the closed condition and fluid entering the flow channels 22 of the multi-channel flow member 20 through the screened or ported section 18 of the outer housing 14 is prevented from entering the interior 70 of the production device 134. In the closed position, the assembly behaves as a solid tubing, or solid working drilling string enabling drilling with the ICD assembly, tool testing, packer settings, hole cleaning, and other downhole operations.

Figure 4:
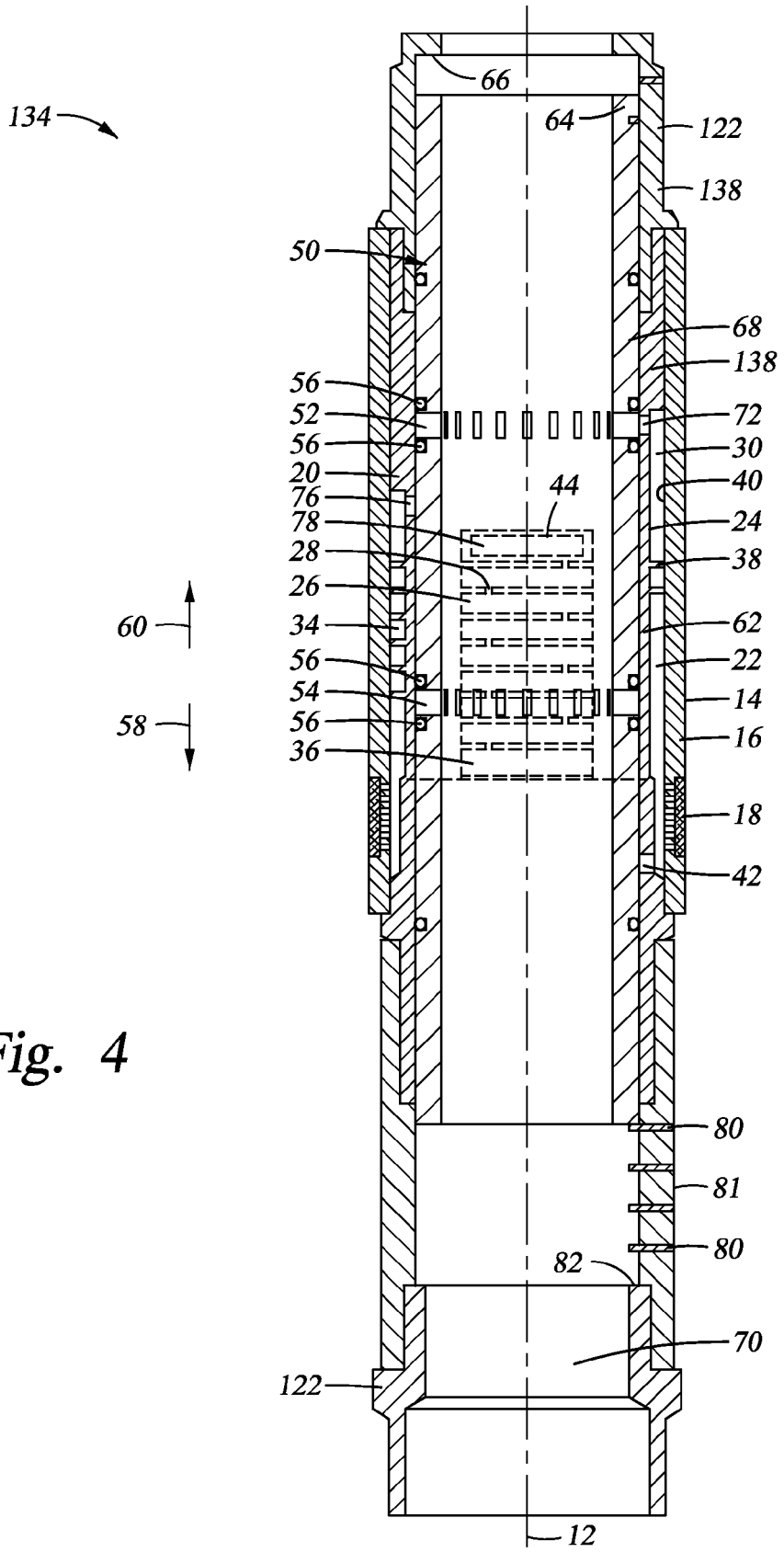
FIG. 4 shows a side partial section view of the adjustable flow control device of FIG. 3 in a second position.
Figure 5:
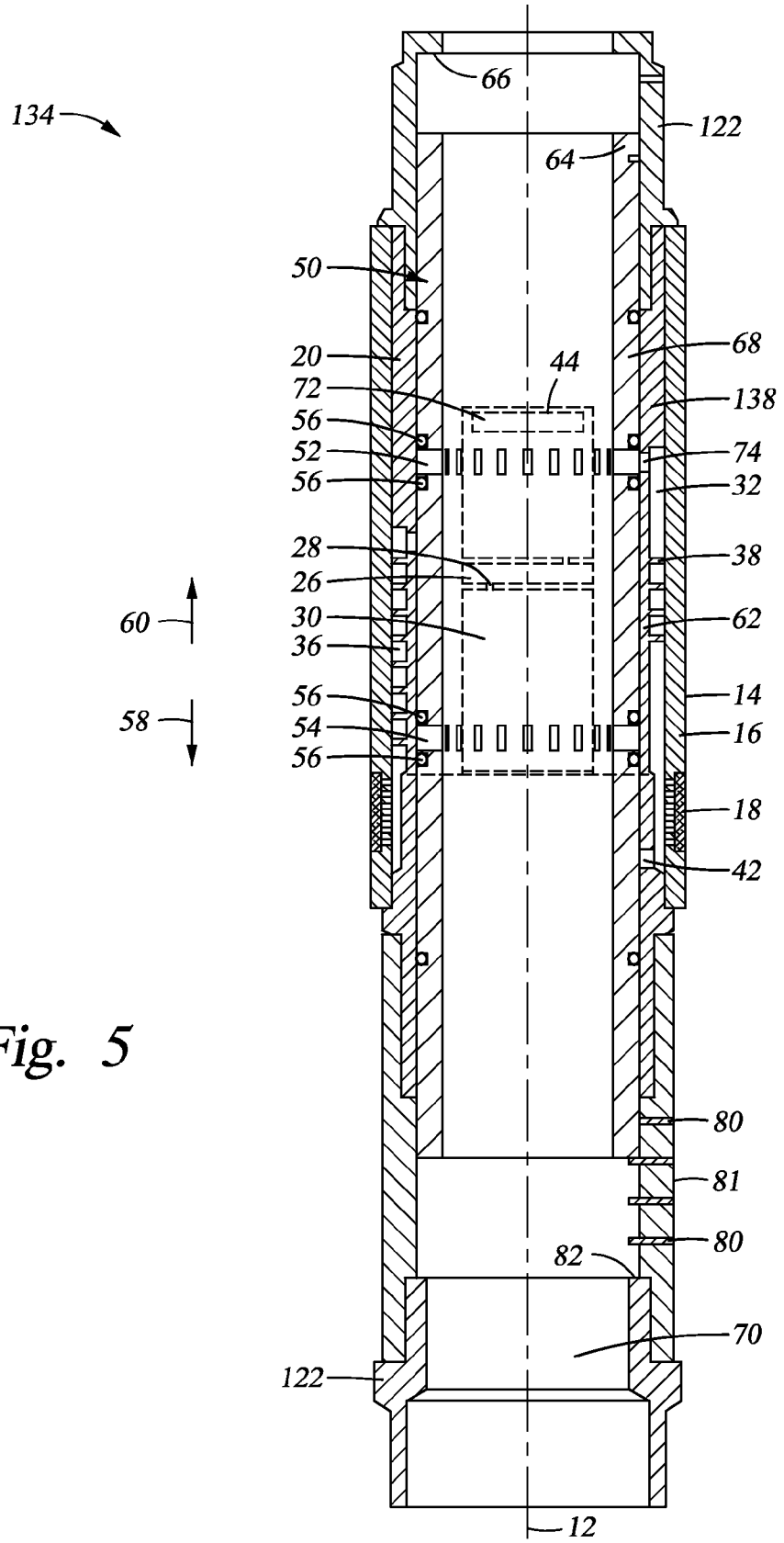
FIG. 5 shows a side partial section view of the adjustable flow control device of FIG. 3 in a third position.

By longitudinally moving the sliding sleeve 50 in direction 58 to a second position as shown in FIG. 4, the first section of radial slots 52 of the sliding sleeve 50 are aligned or at least substantially aligned with the first radial window 72 of the first flow channel 30, while the second section of radial slots 54 of the sliding sleeve 50 are blocked from fluid communication with the flow channels 22 by imperforate sections 62 of the multi-channel flow member 20. Also, the remainder of the radial windows 74, 76, 78 of the second through fourth flow channels 32, 34, 36, as well as the bypass port 42, are blocked from fluid communication with the interior 70 of the production device 134 by imperforate sections 68 of the sliding sleeve 50. In the second position, fluids passing into the multi-channel flow member 20 through the screened section 18 of the outer housing 14 are only allowed to enter the interior 70 of the production device 134 through the first radial window 72 and thus enter under the first flow resistance rating, e.g. 0.8 FRR. The downhole-adjustable flow control device 138 may include one or more position indicators 80 to provide an indication to an operator or mechanical system that the second position has been reached. Such position indicators 80 may protrude radially inward from the tubing 122 or from a tubular shaped segment 81, interconnecting the tubing 122 to the flow member 20. The position indicators 80 may provide a physical indication to an operator that a particular position has been reached, but further movement of the sleeve 50 is not prohibited with a set amount of force applied to the sleeve 50 relative to the flow member 20, segment 81, and tubing 122. Alternate position indicators 80 may also be incorporated.

By longitudinally moving the sliding sleeve 50 in direction 58 to a third position as shown in HG, 5, the first section of radial slots 52 of the sliding sleeve 50 are aligned or at least substantially aligned with the radial window 74 of the second flow channel 32, while the second section of radial slots 54 of the sliding sleeve 50 are blocked from fluid communication with the flow channels 22 by imperforate sections 62 of the multi-channel flow member 20. Also, the remainder of the radial windows 72, 76, 78 of the first, third, and fourth flow channels 30, 34, 36, as well as the bypass port 42, are blocked from fluid communication with the interior 70 of the production device 134 by imperforate sections 68 of the sliding sleeve 50. In the third position, fluids passing into the multi-channel flow member 20 through the screened section 18 of the outer housing 14 are only allowed to enter the interior 70 of the production device 134 through the second radial window 74 and thus enter under the second flow resistance rating, e.g. 1.6 FRR. The downhole-adjustable flow control device 138 may include a position indicator 80 or stop to provide an indication to an operator or mechanical system that the third position has been reached.

Figure 6:
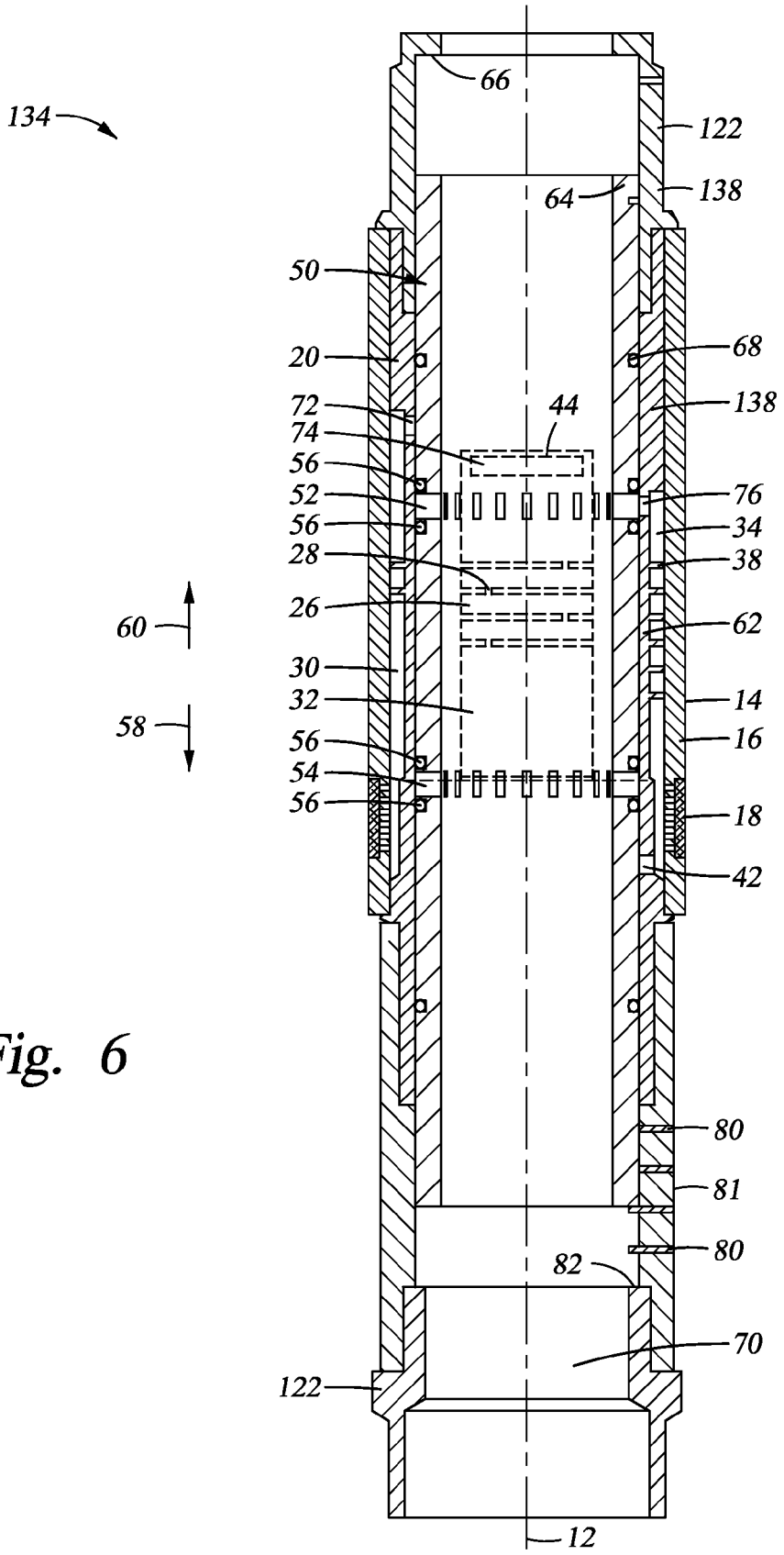
FIG. 6 shows a side partial section view of the adjustable flow control device of FIG. 3 in a fourth position.

By longitudinally moving the sliding sleeve 50 in direction 58 to a fourth position as shown in FIG. 6, the first section of radial slots 52 of the sliding sleeve 50 are aligned or at least substantially aligned with the radial window 76 of the third flow channel 34, while the second section of radial slots 54 of the sliding sleeve 50 are blocked from fluid communication with the flow channels 22 by imperforate sections 62 of the multi-channel flow member 20. Also, the remainder of the radial windows 72, 74, 78 of the first, second, and fourth flow channels 30, 32, 36, as well as the bypass port 42, are blocked from fluid communication with the interior 70 of the production device 134 by imperforate sections 68 of the sliding sleeve 50. In the fourth position, fluids passing into the multi-channel flow member 20 through the screened section 18 of the outer housing 14 are only allowed to enter the interior 70 of the production device 134 through the third radial window 76 and thus enter under the third flow resistance rating, e.g. 3.2 FRR. The downhole-adjustable flow control device 138 may include a position indicator or stop to provide an indication to an operator or mechanical system that the fourth position has been reached.

Figure 7:
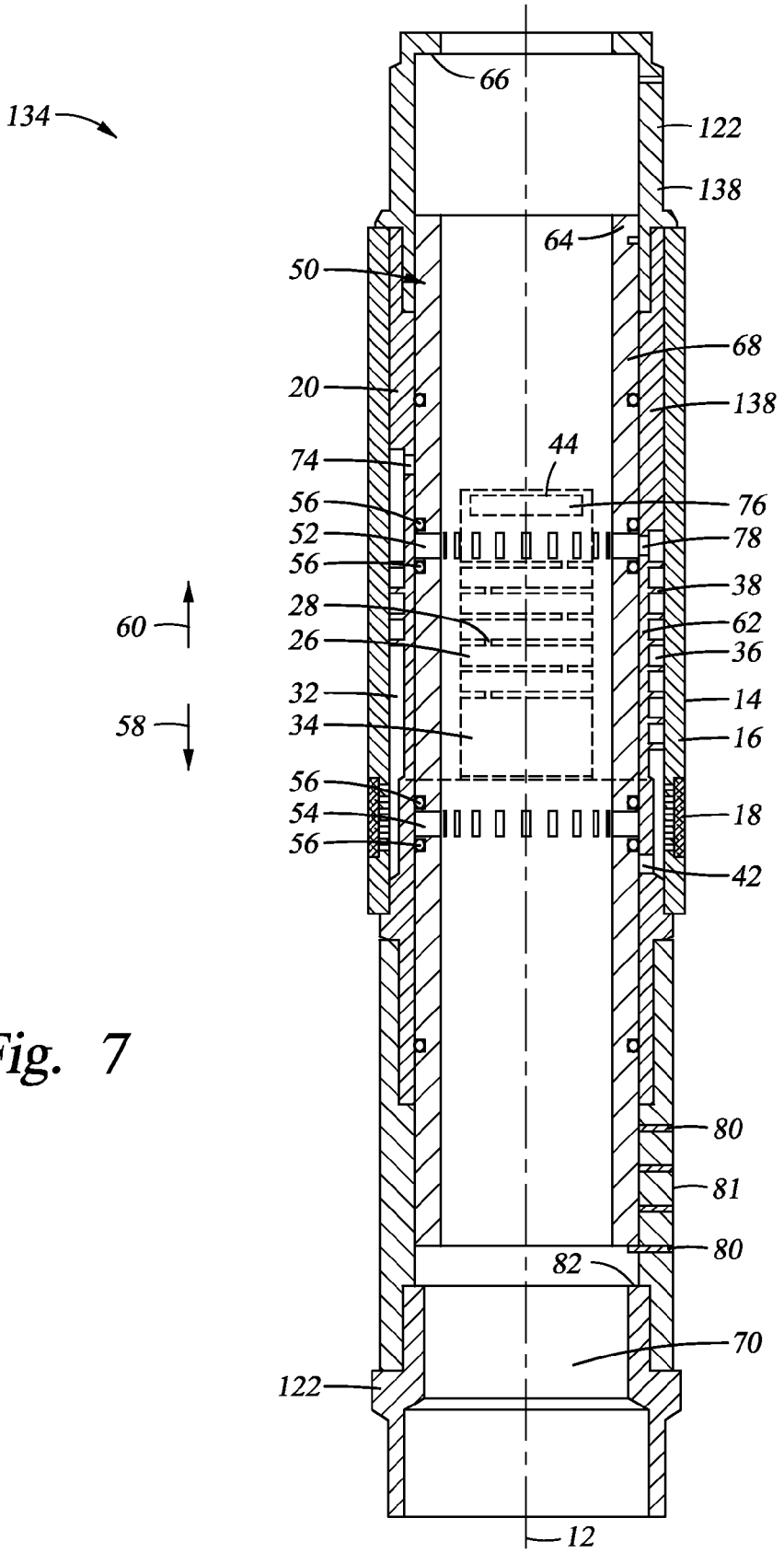
FIG. 7 shows a side partial section view of the adjustable flow control device of FIG. 3 in a fifth position.

By longitudinally moving the sliding sleeve 50 in direction 58 to a fifth position as shown in FIG. 7, the first section of radial slots 52 of the sliding sleeve 50 are aligned or at least substantially aligned with the radial window 78 of the fourth flow channel 36, while the second section of radial slots 54 of the sliding sleeve 50 are blocked from fluid communication with the flow channels 22 by imperforate sections 62 of the multi-channel flow member 20. Also, the remainder of the radial windows 72, 74, 76 of the first, second, and third flow channels 30, 32, 34, as well as the bypass port 42, are blocked from fluid communication with the interior 70 of the production device 134 by imperforate sections 68 of the sliding sleeve 50. In the fifth position, fluids passing into the multi-channel flow member 20 through the screened section 18 of the outer housing 14 are only allowed to enter the interior 70 of the production device 134 through the fourth radial window 78 and thus enter under the fourth flow resistance rating, e.g. 6.4 FRR. The downhole-adjustable flow control device 138 may include a position indicator or stop to provide an indication to an operator or mechanical system that the fifth position has been reached.

Figure 8:
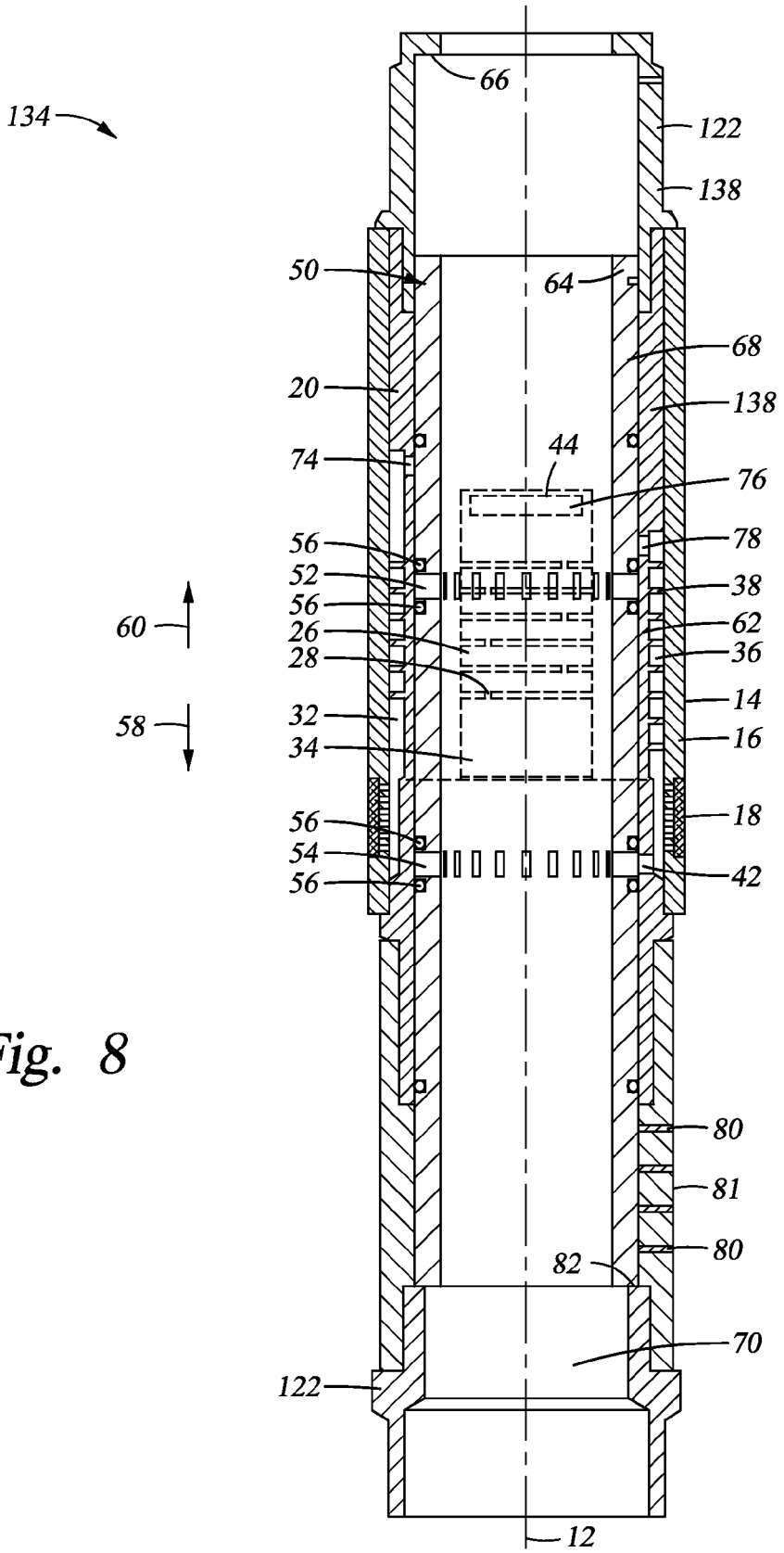
FIG. 8 shows a side partial section view of the adjustable flow control device of FIG. 3 in a sixth position, corresponding to an open position; and, FIG. 9 shows a schematic diagram depicting a portion of an embodiment of a sliding sleeve positioned in relation to various flow paths of an embodiment of a multi-channel flow path tubular of the adjustable flow control device of FIG. 3.

By longitudinally moving the sliding sleeve in direction 58 to a sixth position, such as an end position, as shown in FIG. 8, the first section of radial slots 52 of the sliding sleeve 50 are blocked from the radial windows 72, 74, 76, 78 of the first through fourth flow channels 30, 32, 34, 36, while the second section of radial slots 54 of the sliding sleeve 50 are aligned, or at least substantially aligned, with the bypass ports 42, which in turn is substantially aligned with the screened section 18 of the outer housing 14. In the sixth position, fluids passing into the multi-channel flow member 20 through the screened or ported section 18 of the outer housing 14 enter the interior 70 of the production device 134, bypassing the flow channels 22 of the downhole-adjustable flow control device 138. Thus, the sixth position may be considered an open or by-pass position since all of the FRR radial windows 72, 74, 76, 78 are closed and the fluid from the formation can go through to the interior 70 of the production device 134 by-passing the FRR channels 22. In this position, production from a formation is not resisted, or any treatment (e.g. fluid injection) can be performed as the flow control device 138 is by-passed. A second shoulder 82 may be provided in the tubing 122 such that the sliding sleeve 50 is stopped with respect to the multi-channel flow member 20 to ensure that the alignment of the second section of radial slots 54 with the by-pass port 42 is achieved and maintained as desired.

Figure 9:
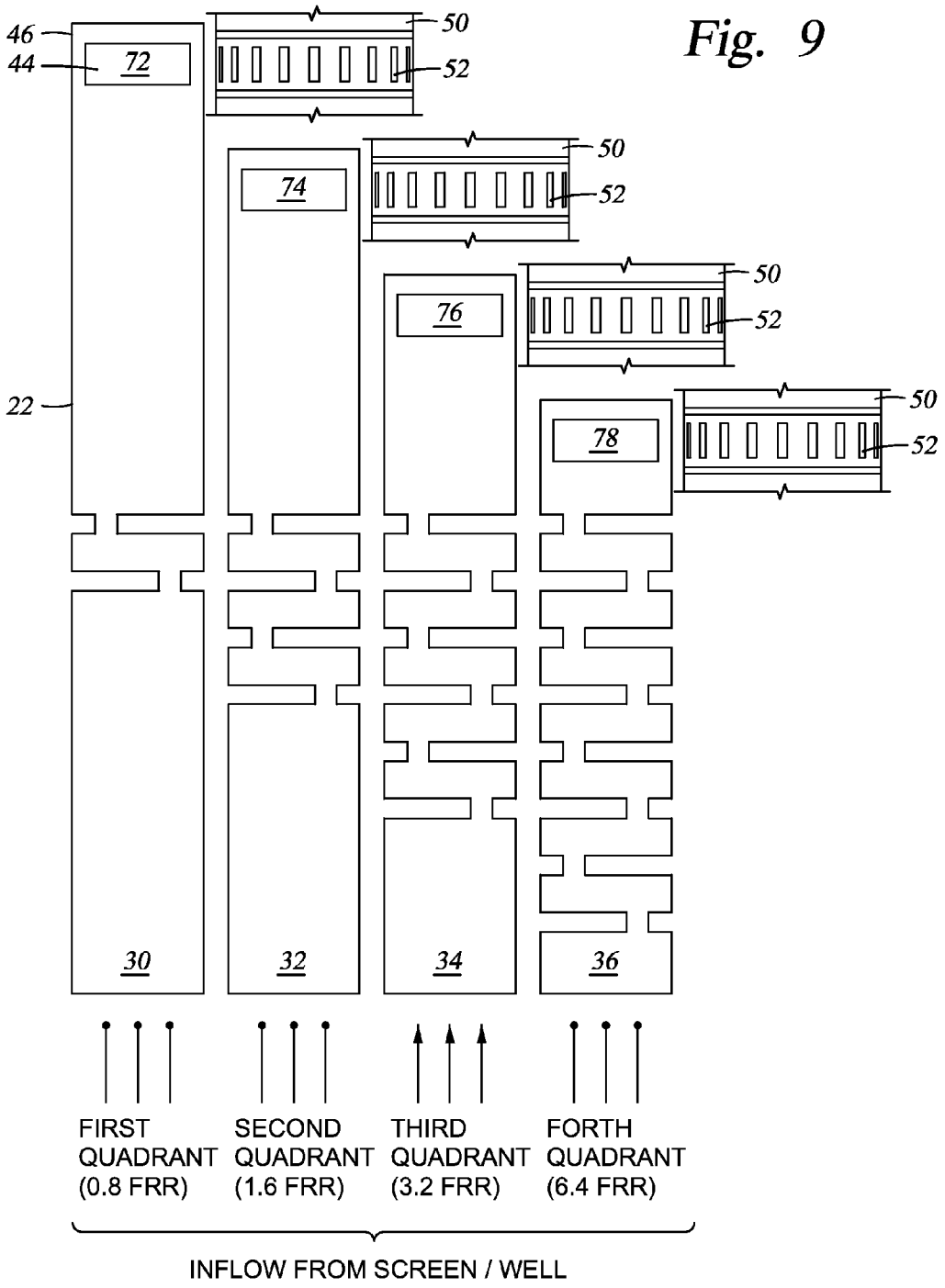

With reference to FIG. 9, an embodiment of the tortuous paths of the first through fourth flow channels 30, 32, 34, 36 is shown in relation to a portion of the sliding sleeve 50 having the first section of radial slots 52. FIG. 9 demonstrates how the first through fourth radial windows 72, 74, 76, 78 are longitudinally spaced from each other, so that only one of the flow channels 30, 32, 34, 38 is communicated with at one time by the first section of radial slots 52. Also, in the illustrated embodiment (see FIGS. 3-8), movement in one direction 58 increases the flow resistance of fluid entering the flow control device 138 from one flow channel 22 to the next, while movement in the opposite direction 60 decreases the flow resistance of fluid entering the flow control device 138 from one flow channel 22 to the next.

Thus, in an embodiment of the invention, an adjustable downhole active inflow control device ("ICD") 138 conforms to a completion hook-up and is usable to change the flow rate in particular flow zones starting or producing undesirables fluids without pulling a production string 120 out from the hole 110. The ICD 138 includes an axially movable sleeve 50 having positive position indicators 80 and radially flow open ports 54 enclosed between, but not limited to, chevron seal stacks 56 alignable to particular flow restrictor ports 72 of the inner tubular that lead to a multi-channel flow member 20 choking the flow. In another embodiment of the invention, both inner tubular 20 and sliding sleeve 50 open (FIG. 8) and close (FIG. 3) formation-borehole communication enabling hydraulic tool testing, packers setting, gravel packing, stimulation or fracturing without compromising the multi-channel integrity of the flow channels 22. Advantages, features and benefits of the invention further rely on the potential installation of a drilling hook-up to substantially reduce rig time for this particular application and from the included drawings, description and claims.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A flow control device having a longitudinal axis and comprising:

an outer housing having at least one fluid inlet;

a multi-channel flow member positioned radially within the outer housing, a plurality of flow channels formed between the outer housing and the flow member, at least two of the plurality of flow channels having a different flow resistance rating from each other, and a radial window formed in an outlet region of each of the plurality of flow channels; and, a sliding sleeve positioned radially within the multi-channel flow member, the sliding sleeve including a first section of radial slots;

wherein the first section of radial slots is configured to align with a selected radial window via longitudinal movement of the sliding sleeve with respect to the multi-channel flow member.

2. The flow control device of claim 1, wherein the fluid inlet in the outer housing is screened.

3. The flow control device of claim 1, wherein, when the first section of radial slots is misaligned from each radial window, fluid communication between the fluid inlet and an interior of the sliding sleeve is prevented.

4. The flow control device of claim 1, wherein the multi-channel flow member further comprises a by-pass port substantially aligned with the fluid inlet, the sliding sleeve longitudinally movable to fluidically communicate the by-pass port with an interior of the sliding sleeve.

5. The flow control device of claim 4, wherein the sliding sleeve includes a second section of radial ports longitudinally spaced from the first section of radial ports, and the second section of radial ports is configured to align with the by-pass port when the first section of radial ports is misaligned from each radial window.

6. The flow control device of claim 1, wherein the outer housing and the multi-channel flow member are longitudinally fixed relative to each other.

7. The flow control device of claim 1, wherein each radial window in the at least two of the plurality of flow channels is longitudinally spaced from each other.

8. The flow control device of claim 1, wherein the at least two of the plurality of flow channels includes four flow channels having first, second, third, and fourth radial windows longitudinally spaced from each other.

9. The flow control device of claim 8, wherein each of the four flow channels has a different flow resistance rating from each other.

10. The flow control device of claim 1, wherein the first section of radial slots is framed by a pair of seal assemblies.

11. The flow control device of claim 10, wherein each seal assembly includes a seal stack.

12. The flow control device of claim 1, wherein each flow channel is fluidically isolated from other flow channels in the plurality of flow channels.

13. The flow control device of claim 1, wherein each flow channel has a flow path in an axial direction with unique flow properties relative to other flow channels and wherein only one of the plurality of flow channels is fluidically communicable with an interior of the sliding sleeve at a time.

14. The flow control device of claim 1, further comprising a plurality of longitudinally spaced indicators configured to provide an indication when the first section of radial slots aligns with each radial window.

15. The flow control device of claim 14, further comprising at least one supporting tubular, the at least one supporting tubular including the plurality of indicators.

16. A method of controlling flow between an annulus of a borehole and an interior of a tubing using the flow control device of claim 1, the method comprising:

selecting a desired flow resistance rating amongst the plurality of flow channels; and, moving the sliding sleeve longitudinally within the multi-channel flow member until the first section of slots aligns with the radial window of a flow channel having the desired flow resistance rating.

17. The method of controlling flow of claim 16, further comprising engaging the sliding sleeve with an indicator when the first section of slots is aligned with each radial window.

18. The method of controlling flow of claim 16, further comprising moving the sliding sleeve to misalign the first section of slots with each of the radial windows to prevent fluid communication between the interior of the sliding sleeve and the fluid inlet.

19. The method of controlling flow of claim 16, further comprising by-passing the flow channels by aligning a second section of slots with a by-pass port in the multi-channel flow member.

20. The method of controlling flow of claim 19, further comprising treating the annulus through the second section of slots, by-pass port, and fluid inlet, wherein treating includes at least one of hydraulic fracturing, stimulation, tracer injection, cleaning, acidizing, steam injection, water flooding, and cementing.

21. The method of controlling flow of claim 16, further comprising drilling the bore hole using the flow control device as a drilling hook-up assembly.

* * * * *